US012747910B2

(12) United States Patent
Heo et al.

(10) Patent No.: US 12,747,910 B2
(45) Date of Patent: Sep. 29, 2026

(54) REFRIGERATOR

(71) Applicant: SAMSUNG ELECTRONICS CO., LTD., Suwon-si (KR)

(72) Inventors: Eun Heo, Suwon-si (KR); Huido Park, Suwon-si (KR); Kyoungsun Park, Suwon-si (KR); Jisick Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 166 days.

(21) Appl. No.: 18/214,766

(22) Filed: Jun. 27, 2023

(65) Prior Publication Data

US 2024/0085097 A1 Mar. 14, 2024

Related U.S. Application Data

(63) Continuation of application No. PCT/KR2023/008296, filed on Jun. 15, 2023.

(30) Foreign Application Priority Data

Sep. 13, 2022 (KR) ..... 10-2022-0115239

(51) Int. Cl.

| | |
|---|---|
| ***F25D 25/02*** | (2006.01) |
| ***F25D 17/04*** | (2006.01) |
| *F25D 11/00* | (2006.01) |

(52) U.S. Cl.

CPC ..... *F25D 25/025* (2013.01); *F25D 17/045* (2013.01); *F25D 25/02* (2013.01);
(Continued)

(58) Field of Classification Search

CPC ..... F25D 25/025; F25D 25/02; F25D 17/045; F25D 17/04; F25D 2317/061; F25D 2317/066; F25D 2317/04131

See application file for complete search history.

(56) References Cited

U.S. PATENT DOCUMENTS 4,557,118 A * 12/1985 Pink ..... F25D 17/045 62/382
9,140,483 B2 9/2015 Park et al.
(Continued)

FOREIGN PATENT DOCUMENTS

CN 101203721 A 6/2008
CN 110332756 A * 10/2019 ..... F25D 25/025
(Continued)

OTHER PUBLICATIONS

Communication dated Sep. 26, 2023, issued by the International Searching Authority in International Application No. PCT/KR2023/008296 (PCT/ISA/210).
(Continued)

*Primary Examiner* — Kimberley S Wright
(74) *Attorney, Agent, or Firm* — Sughrue Mion, PLLC

(57) ABSTRACT

A refrigerator includes a main body; a storage chamber provided in the main body so that a front side of the storage chamber is open; a drawer provided in the storage chamber and configured to be inserted into and withdrawn from the storage chamber, wherein an interior of the drawer forms a storage space; a shelf provided on the drawer, wherein a front surface of the shelf and the drawer are spaced apart by a gap; a cover vertically movably connected to the shelf and configured to cover the gap; and a cover position adjuster contacting the shelf and the cover and configured to adjust an area of the gap by vertically moving the cover.

17 Claims, 19 Drawing Sheets

(52) U.S. Cl.
CPC ..... *F25D 11/00* (2013.01); *F25D 17/04* (2013.01); *F25D 2317/04131* (2013.01); *F25D 2317/061* (2013.01); *F25D 2317/066* (2013.01)

(56) References Cited

U.S. PATENT DOCUMENTS

| | | | | |
|---|---|---|---|---|
| 9,429,354 | B2 | 8/2016 | Ha et al. | |
| 10,962,281 | B2 | 3/2021 | Lee et al. | |
| 2006/0016210 | A1 | 1/2006 | Lee et al. | |
| 2009/0199587 | A1 | 8/2009 | Matthews et al. | |
| 2012/0146477 | A1* | 6/2012 | Bischofberger | F25D 25/025 312/404 |
| 2013/0270986 | A1* | 10/2013 | Min | F25D 25/025 220/361 |
| 2017/0292766 | A1 | 10/2017 | Lee | |
| 2018/0156534 | A1* | 6/2018 | Alyanak | F25D 25/025 |
| 2018/0187966 | A1* | 7/2018 | Lee | F25D 17/042 |
| 2021/0348826 | A1* | 11/2021 | Heo | F25D 25/02 |
| 2022/0364783 | A1* | 11/2022 | Kang | F25D 25/02 |

FOREIGN PATENT DOCUMENTS

| | | | | |
|---|---|---|---|---|
| CN | 110411109 A | * | 11/2019 | F25D 11/02 |
| CN | 211012050 U | * | 7/2020 | |
| EP | 3115720 A1 | * | 1/2017 | F25D 25/025 |
| EP | 3077739 B1 | | 3/2018 | |
| EP | 3343156 A1 | | 7/2018 | |
| EP | 2473797 B1 | | 4/2019 | |
| JP | 6799744 B2 | | 12/2020 | |
| KR | 10-2006-0032439 A | | 4/2006 | |
| KR | 10-2007-0030511 A | | 3/2007 | |
| KR | 10-2010-0007495 A | | 1/2010 | |
| KR | 10-2014-0121536 A | | 10/2014 | |
| KR | 10-1461961 B1 | | 11/2014 | |
| KR | 10-2016-0018058 A | | 2/2016 | |
| KR | 10-1811321 B1 | | 12/2017 | |
| KR | 10-2018-0080053 A | | 7/2018 | |
| WO | 2015/082279 A1 | | 6/2015 | |
| WO | 2022/181974 A1 | | 9/2022 | |

OTHER PUBLICATIONS

Communication dated Sep. 26, 2023, issued by the International Searching Authority in International Application No. PCT/KR2023/008296 (PCT/ISA/237).

Extended European Search Report issued Jun. 26, 2025 by the European Patent Office for EP Patent Application No. 23865666.4.

* cited by examiner

REFRIGERATOR

CROSS-REFERENCE TO RELATED APPLICATIONS

This application is a by-pass continuation application of International Application No. PCT/KR2023/008296, filed on Jun. 15, 2023, which is based on and claims the priority benefit of Korean Patent Application No. 10-2022-0115239, filed on Sep. 13, 2022, in the Korean Intellectual Property Office, the disclosures of which are incorporated by reference herein in their entireties.

BACKGROUND

1. Field

The present disclosure relates to a refrigerator in which an area of a gap formed between a drawer and a front surface of a shelf is adjusted to adjust a humidity in the drawer.

2. Description of Related Art

A refrigerator is an apparatus provided with a main body, which includes a storage chamber, and a cold air supply system configured to supply cold air to the storage chamber to keep food fresh. The storage chamber includes a cold storage chamber maintained at about 0 to 5° C. to refrigerate food and a freezer chamber maintained at about 0 to −30° C. to freeze and store food.

A plurality of shelves for convenience of storage may be provided in each of the cold storage chamber and the freezer chamber, and a drawer, which is a drawer-type door, may be provided to store food in a moist state.

For example, a vegetable box or the like for storing food such as vegetables and fruits that should be stored in a moist state to maintain freshness may be provided in a lower portion of the cold storage chamber.

SUMMARY

Provided is a refrigerator in which a front gap formed between a drawer and a front surface of a shelf is adjusted to adjust a humidity in the drawer.

In addition, provided is a refrigerator in which a cover which covers a front gap is connected to a shelf and the cover vertically moves to adjust an area of the front gap.

In addition, provided is a refrigerator in which an adjustment device configured to vertically move a cover is provided on a front surface of the cover to vertically move the cover according to an operation of the adjustment device.

Additional aspects will be set forth in part in the description which follows and, in part, will be apparent from the description, or may be learned by practice of the presented embodiments.

According to an aspect of the disclosure, a refrigerator includes: a main body; a storage chamber provided in the main body so that a front side of the storage chamber is open; a drawer provided in the storage chamber and configured to be inserted into and withdrawn from the storage chamber, wherein an interior of the drawer forms a storage space; a shelf provided on the drawer, wherein a front surface of the shelf and the drawer are spaced apart by a gap; a cover vertically movably connected to the shelf and configured to cover the gap; and a cover position adjuster contacting the shelf and the cover and configured to adjust an area of the gap by vertically moving the cover.

The cover position adjuster may include: a moving bracket connected to a front surface of the cover and configured to move in a left-right direction; a lever protruding forward from a front surface of the moving bracket; and at least one boss protruding rearward from a rear surface of the moving bracket and configured to vertically move the cover as the moving bracket moves in the left-right direction.

The cover may include: a cover part configured to cover the gap; a pair of extensions extending rearward from two ends of the cover part; and a pair of rotation shafts on the pair of extensions and rotatably connected to the shelf.

The cover part may include at least one guide rail configured to receive the at least one boss and to guide the at least one boss as the moving bracket moves in the left-right direction.

The at least one guide rail may be obliquely formed so that the cover is vertically rotated around the pair of rotation shafts as the moving bracket moves in the left-right direction.

The front surface of the shelf may include an opening in which the lever is received and exposed to an outside; and the lever may be configured to move along the opening in the left-right direction.

The shelf may include a pair of rotation holes to which the pair of rotation shafts are rotatably coupled.

The cover position adjuster may include a lever integrally formed with the cover and configured to vertically move with the cover; and the lever may protrude forward from a front surface of the cover.

The cover may include: a cover part configured to cover the gap; a pair of extensions extending rearward from two ends of the cover part; and a pair of rotation shafts provided on the pair of extensions and rotatably connected to the shelf.

The front surface of the shelf may include: an opening in which the lever is received and exposed to an outside, and the shelf may include: a support rib protruding rearward from a lower portion of the front surface of the shelf under the opening and configured to support the cover; and a pair of rotation holes to which the pair of rotation shafts are rotatably connected.

The support rib may be configured to support the cover when the lever is positioned at an upper portion of the opening, rotating the lever downward around the pair of rotation shafts in the opening may cause the cover to escape from the support rib and to rotate downward around the pair of rotation shafts; and the lever may be supported by a lower end of the opening when the lever is positioned at a lower portion of the opening.

The cover position adjuster may include: a connecting shaft rotatably connected to the front surface of the shelf; a dial lever provided on a front end of the connecting shaft and configured to rotate with the connecting shaft; and a rotation gear fixed to the connecting shaft and configured to rotate with the connecting shaft according to rotation of the dial lever.

The cover may include: a cover part configured to cover the gap; an accommodation part provided in a central portion of the cover part a space in which the rotation gear is accommodated; a rack gear engaged with the rotation gear to vertically move according to rotation of the rotation gear; a pair of extensions extending rearward from two ends of the cover part; and a pair of moving shafts provided on the pair of extensions and vertically movably connected to the shelf.

The shelf may include: a through hole through which the connecting shaft passes; a fixing groove in which a rear end of the connecting shaft is rotatably fixed; and a pair of guide holes configured to receive the pair of moving shafts and to guide the pair of moving shafts to move vertically.

Rotation of the dial lever in a left-right direction may cause the cover to vertically move through engagement of the rotation gear with the rack gear, and cause the pair of moving shafts to vertically move along the pair of guide holes.

According to an aspect of the disclosure refrigerator includes: a main body; a storage chamber provided in the main body so that a front side of the storage chamber is open; a drawer provided in the storage chamber and configured to be inserted into and withdrawn from the storage chamber, wherein an interior of the drawer forms a storage space; a shelf provided on the drawer, wherein a front surface of the shelf and the drawer are spaced apart by a gap; a cover configured to cover the gap and to vertically move to adjust an area of the gap; and a cover position adjuster provided on a front surface of the cover and configured to vertically move the cover to adjust a humidity in the storage space.

The cover position adjuster may include a lever exposed to an outside through an opening formed in the front surface of the shelf, and the cover may be connected to the lever and configured to be vertically moved by the lever.

The cover may include a pair of rotation shafts vertically rotatably connected to the shelf; and the cover may be configured to vertically rotate around the pair of rotation shafts when the lever is moved within the opening.

The cover position adjuster may include: a connecting shaft rotatably connected to the front surface of the shelf; a dial lever provided on a front end of the connecting shaft and configured to rotate with the connecting shaft; and a rotation gear fixed to the connecting shaft and configured to rotate with the connecting shaft according to rotation of the dial lever.

The cover may include a rack gear engaged with the rotation gear to vertically move according to rotation of the rotation gear, and rotation of the dial lever in a left-right direction may cause the cover to vertically move.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
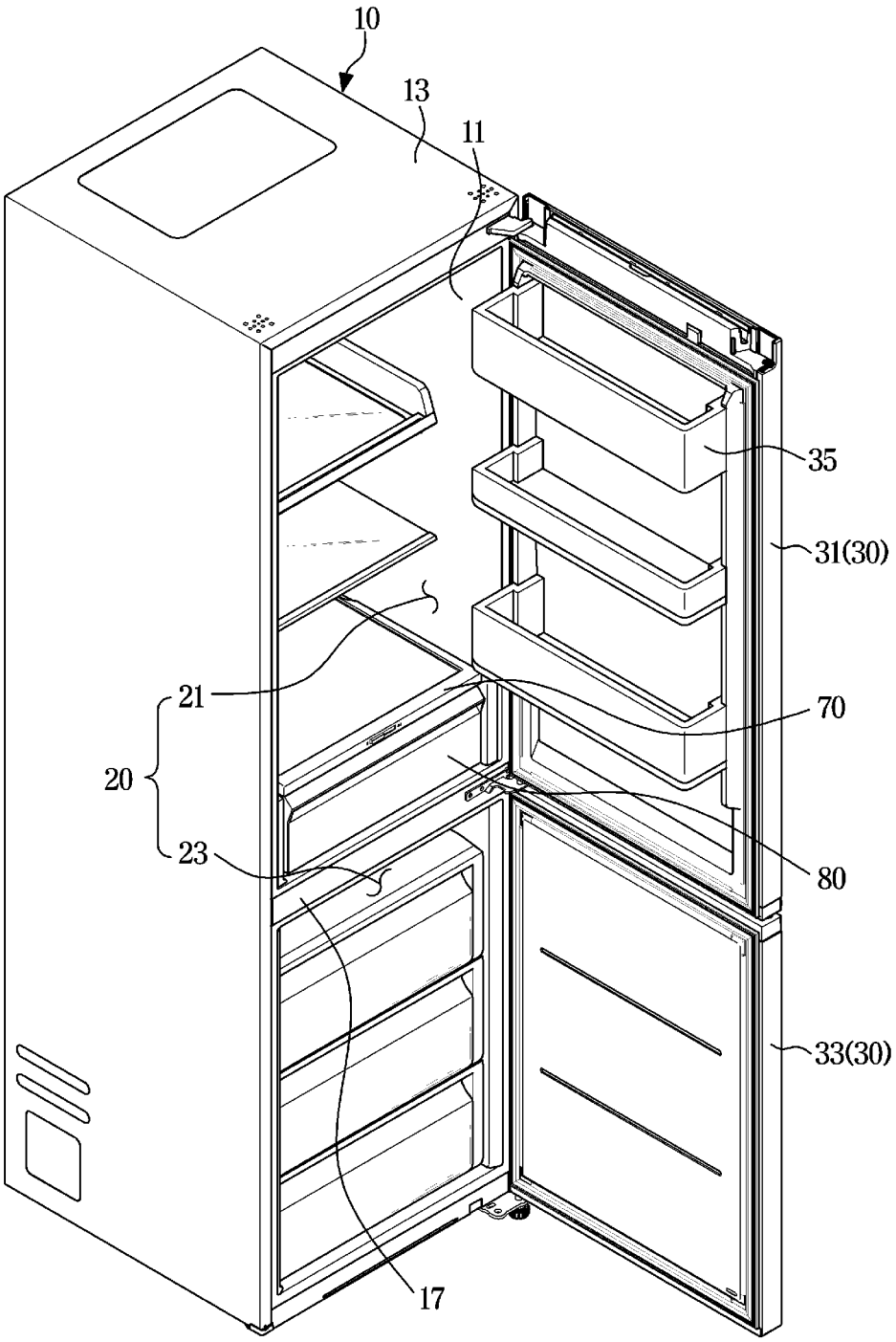
FIG. 1 is a perspective view illustrating a refrigerator according to an embodiment.

Embodiments described in the present specification and configurations illustrated in the accompanying drawings are only exemplary examples of the disclosed disclosure. The disclosure may have variously modified embodiments which may substitute for one or more embodiments and drawings of the present specification at the time of filing of this application.

In addition, the same reference numerals or symbols refer to parts or components which substantially perform the same function.

In addition, terms used in the present specification are merely used to describe exemplary embodiments, and are not intended to limit and/or restrict the embodiments. An expression used in the singular encompasses the expression of the plural unless it has a clearly different meaning in context. In the present specification, terms such as "including," "having," or "comprising" are intended to indicate the presence of the features, numbers, steps, actions, components, parts, or combinations thereof described in the specification, and are not intended to preclude the possibility which one or more other features, numbers, steps, actions, components, parts, or combinations thereof may be present or added.

In addition, it should be understood that, although the terms "first," "second," and the like may be used in the present specification to describe various components, these components should not be limited by these terms. These terms are only used to distinguish one component from another component. For example, a first component could be called a second component, and, similarly, a second component could be called a first component without departing from the scope of the present disclosure. As used herein, the term "and/or" includes any one or combinations of the associated listed items. As used herein, the expression "at least one of a, b, or c" indicates "only a", "only b", "only c", "both a and b", "both a and c", "both b and c", or "all of a, b, and c".

Terms used in the specification such as "front end," "rear end," "upper portion," "lower portion," "upper end" and "lower end" are defined based on the drawings, and shapes and positions of components are not limited by the terms.

Hereinafter, embodiments according to the present disclosure will be described in detail with reference to the accompanying drawings.

Figure 2:
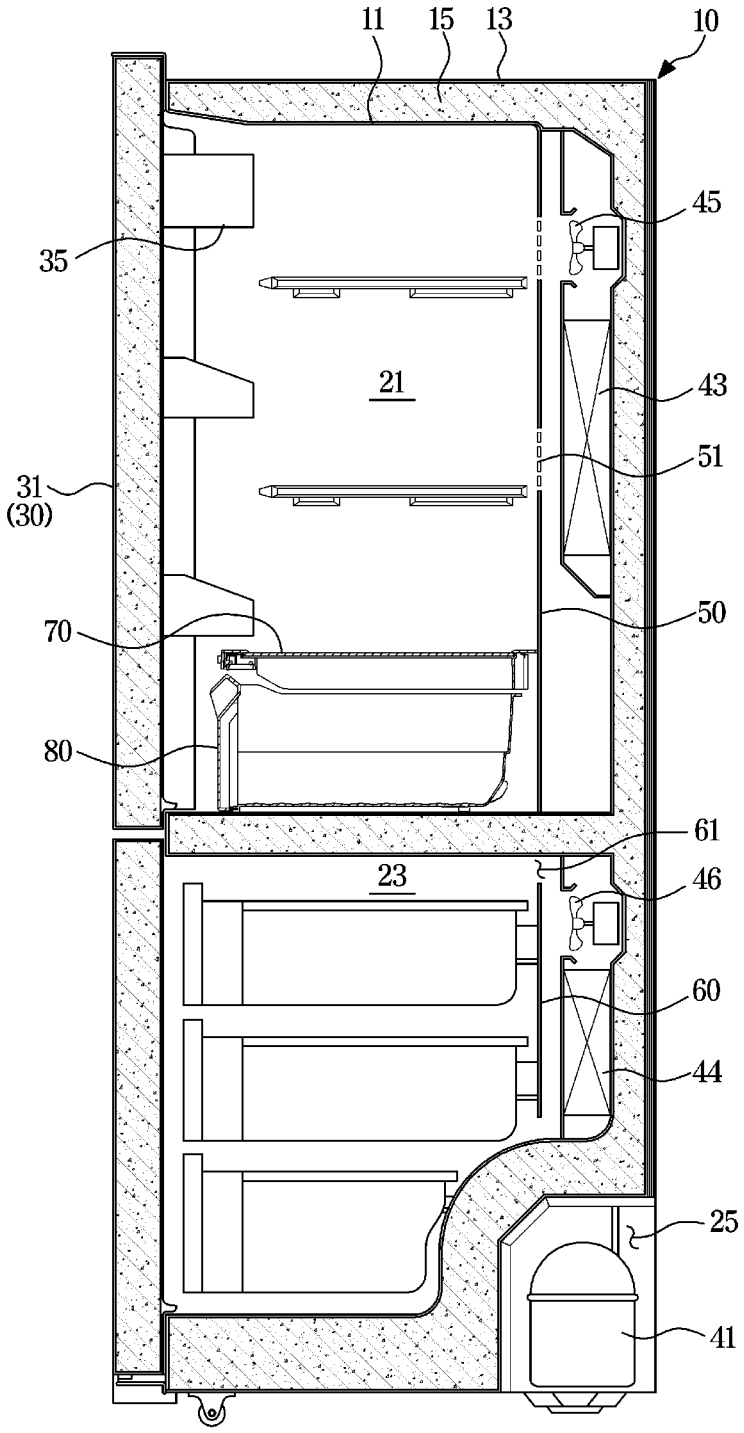
FIG. 2 is a side cross-sectional view illustrating the refrigerator according to an embodiment.

FIG. 1 is a perspective view illustrating a refrigerator according to an embodiment. FIG. 2 is a side cross-sectional view illustrating the refrigerator according to an embodiment.

As illustrated in FIGS. 1 to 2, the refrigerator includes a main body 10, a storage chamber 20 formed in the main body 10, a door 30 which opens or closes the storage chamber 20, and a cold air supply apparatus configured to supply cold air to the storage chamber 20.

The main body 10 includes an inner case 11 in which the storage chamber 20 is formed, an outer case 13 which is coupled to an outer side of the inner case 11 to form an exterior, and an insulator 15 which is foamed between the inner case 11 and the outer case 13 to insulate the storage chamber 20 to prevent leak of cold air.

The storage chamber 20 may be divided by a partition wall 17 into a cold storage chamber 21, which is an upper storage chamber provided in an upper portion of the main body 10, and a freezer chamber 23, which is a lower storage chamber provided in a lower portion of the main body 10. That is, the cold storage chamber 21 may be provided in the upper portion of the main body 10, and the freezer chamber 23 may be provided in a lower portion of the cold storage chamber 21. A plurality of shelves 70 on which food and the like are stacked and stored may be provided in the storage chamber 20 for convenience of storage. In addition, a drawer 80 in which food and the like are placed and stored may be provided in the storage chamber 20 so that the stored food may be stored in a moist state. The drawer 80 may be provided under the shelves 70. The drawer 80 may be provided to be inserted into and withdrawn from the storage chamber 20, and a storage space 81 (see FIG. 4) may be formed in the drawer 80. The drawer 80 may be a vegetable box for storing food such as vegetables and fruits which should be stored in a moist state to maintain freshness.

The cold storage chamber 21 and the freezer chamber 23 are opened or closed by a cold storage chamber door 31 and a freezer chamber door 33, which are rotatably coupled to the main body 10, respectively, and a door guard 35 capable of storing food and the like may be installed as a plurality of door guards 35 on a rear surface of the door 30.

The refrigerator may include the cold air supply apparatus configured to supply the cold air to the storage chamber 20. The cold air supply apparatus may include a compressor 41 installed in a machine room 25 to compress a refrigerant, a condenser installed in the machine room 25 to condense the compressed refrigerant, an expansion valve configured to expand the refrigerant condensed by the condenser, evaporators 43 and 44 installed on a rear surface of the storage chamber 20 and configured to generate cold air, and fans 45 and 46 configured to guide the cold air generated by the evaporators 43 and 44 to supply the cold air to the storage chamber 20. The evaporators 43 and 44 may include a first evaporator 43 disposed behind the cold storage chamber 21 and a second evaporator 44 disposed behind the freezer chamber 23. The fans 45 and 46 may include a first fan 45 disposed behind the cold storage chamber 21 and above the first evaporator 43 and a second fan 46 disposed behind the freezer chamber 23 and above the second evaporator 44.

In addition, the cold air supply apparatus may include cold air ducts 50 and 60 which guide the cold air guided by the fan 45 to the storage chamber 20 and discharge the cold air to the storage chamber 20. The cold air ducts 50 and 60 may include a cold storage chamber cold air duct 50 disposed behind the cold storage chamber 21. The cold storage chamber cold air duct 50 may include a plurality of cold air discharge holes 51 thorough which the cold air generated by the first evaporator 43 is discharged into the cold storage chamber 21. That is, the cold air may be supplied into the cold storage chamber 21 through the cold air discharge holes 51.

The cold air ducts 50 and 60 may include a freezer chamber cold air duct 60 disposed behind the freezer chamber 23. The freezer chamber cold air duct 60 may include a plurality of cold air discharge holes 61 through which the cold air generated by the second evaporator 44 is discharged into the freezer chamber 23. That is, the cold air may be supplied into the freezer chamber 23 through the cold air discharge holes 61.

Figure 3:
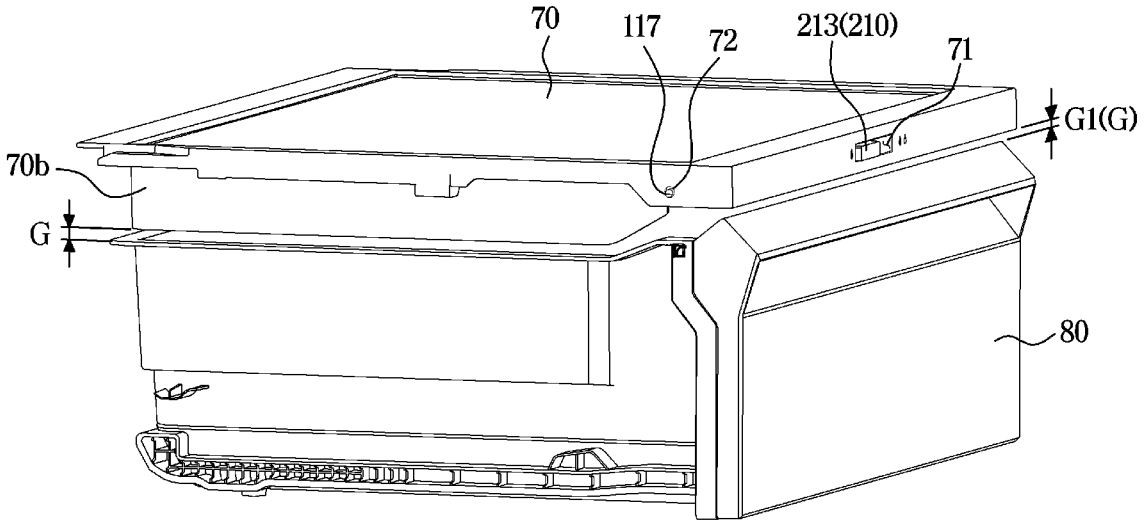
FIG. 3 is a view illustrating a drawer and a shelf which is provided on the drawer and to which a cover and an adjustment device are connected according to an embodiment.
Figure 4:
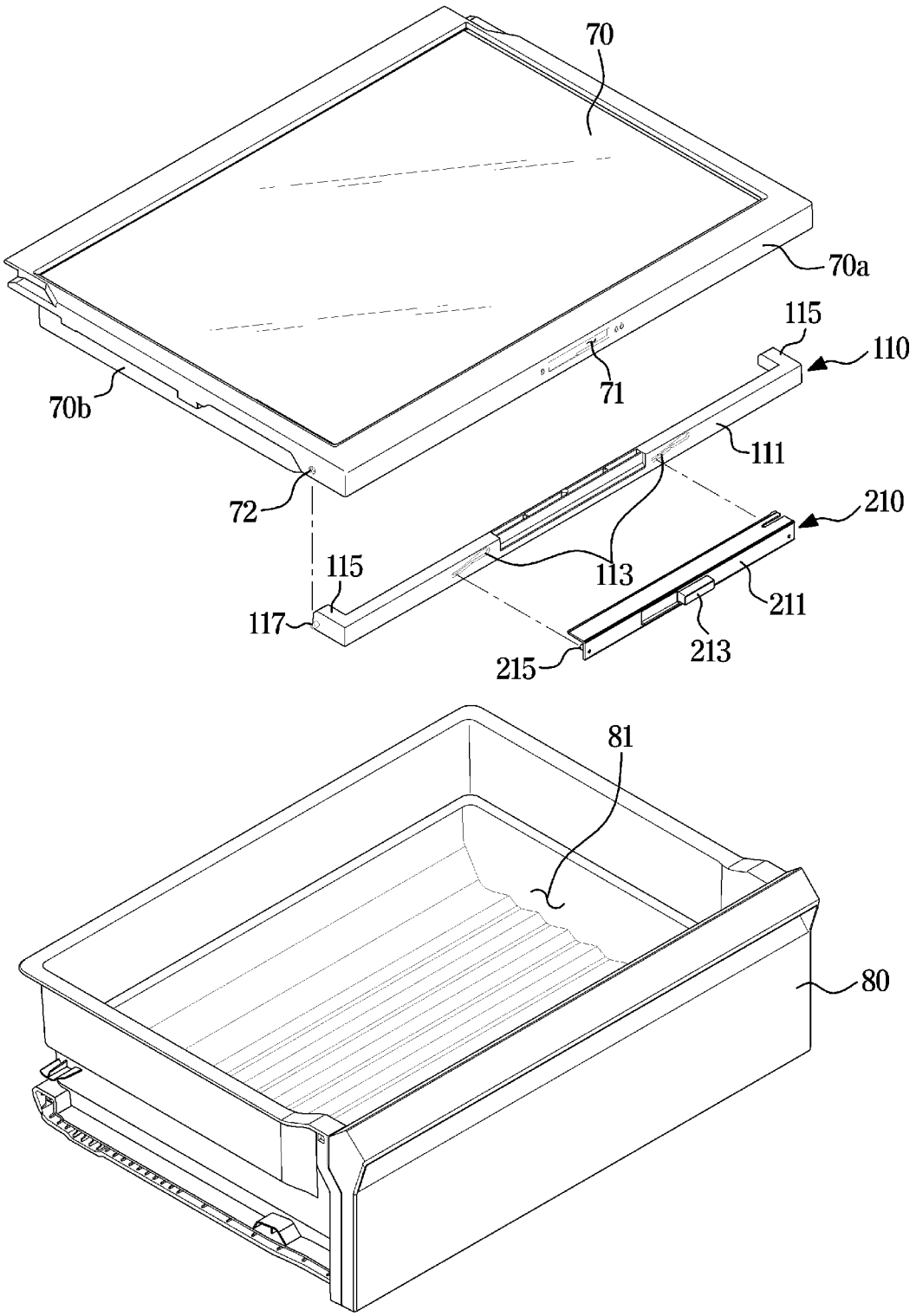
FIG. 4 is a view illustrating the shelf separated from the drawer and the cover and the adjustment device separated from the shelf according to an embodiment.
Figure 5:
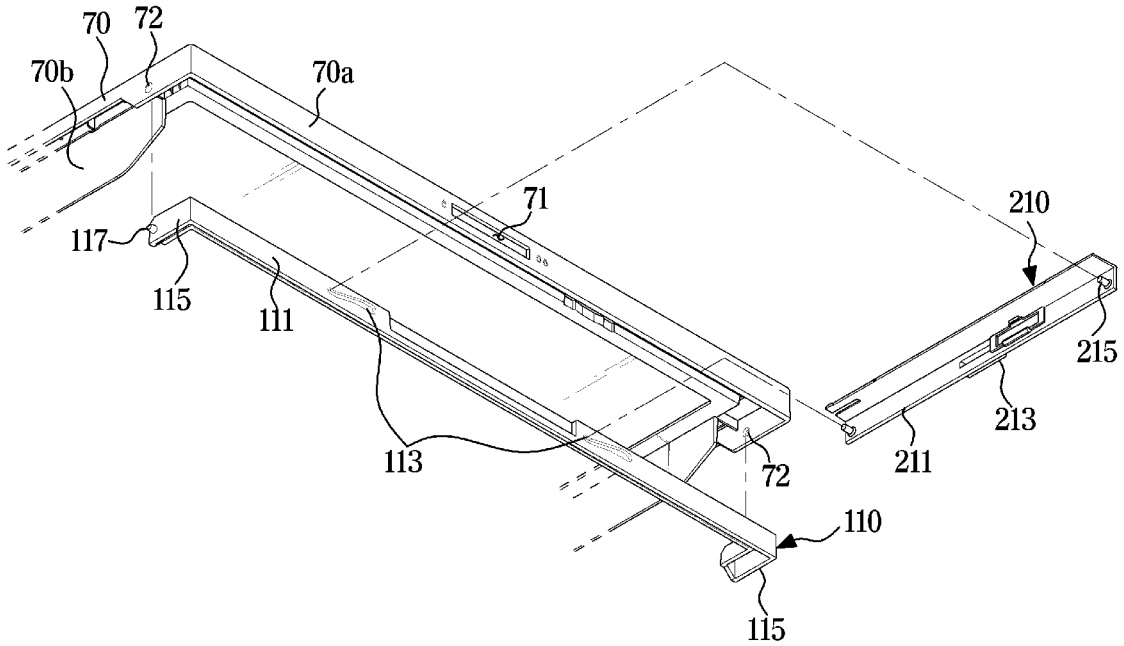
FIG. 5 is a view illustrating the cover and the adjustment device separated from the shelf in a direction different from that of FIG. 4 according to an embodiment.

FIG. 3 is a view illustrating the drawer and the shelf which is provided on the drawer and to which a cover and an adjustment device are connected according to an embodiment. FIG. 4 is a view illustrating the shelf separated from the drawer and the cover and the adjustment device separated from the shelf according to an embodiment. FIG. 5 is a view illustrating the cover and the adjustment device separated from the shelf in a direction different from that of FIG. 4 according to an embodiment.

As illustrated in FIGS. 3 to 5, the shelf 70 may be provided on the drawer 80 so that a gap G is formed between the shelf 70 and the drawer 80. That is, the gap G may be formed between the drawer 80 and a front surface 70*a*, left and right side surfaces, and a rear surface of the shelf 70. The gap G formed between the drawer 80 and the left and right side surfaces and the rear surface, except for the front surface 70*a*, of the shelf 70 may be fixed. That is, a fixing rib 70*b* may be formed in the left and right side surfaces and the rear surface of the shelf 70, and an area of the gap G formed between the drawer 80 and the left and right side surfaces and the rear surface of the shelf 70 may be fixed by the fixing rib 70*b*.

A front gap G1 may be formed between the drawer 80 and the front surface 70*a* of the shelf 70. An area of the front gap G1 may be adjusted by a cover 110. The cover 110 may be vertically movably connected to the shelf 70. The cover 110 may be vertically moved by the adjustment device 210 (also referred to as a cover position adjuster) to adjust an area which covers the front gap G1. That is, an area of the front gap G1 which is not covered by the cover 110 may be adjusted. Since the area of the front gap G1 formed between the drawer 80 and the front surface 70*a* of the shelf 70 is adjusted by the cover 110, a humidity in the storage space 81 in the drawer 80 is adjusted even when the cold storage chamber door 31 (see FIG. 1) is closed. Since the cover 110 covers the entire area of the front gap G1 formed between the drawer 80 and the front surface 70*a* of the shelf 70 and vertically moves to adjust the total area of the front gap G1, the humidity control performance in the storage space 81 can be improved.

The cover 110 may include a cover part 111 which covers the front gap G1 formed between the drawer 80 and the front surface 70*a* of the shelf 70. The cover part 111 may be formed on a front surface of the cover 110 to cover the front gap G1 and may adjust the area which covers the front gap G1 when the cover 110 is vertically moved. That is, when the cover part 111 is rotated upward, the front gap G1 may be fully opened. When the cover part 111 rotated downward, only a part of the front gap G1 may be opened. Accordingly, the cover 110 may be vertically rotated so that the cover part 111 adjusts the area which covers the front gap G1, and thus the area of the front gap G1 can be adjusted.

The cover part 111 may include a pair of guide rails 113 formed on a front surface of the cover part 111. The pair of guide rails 113 may guide a pair of bosses 215 formed in the adjustment device 210 which will be described below. The description of a pair of bosses and a pair of guide rails herein is merely an example, and the disclosure is not limited to this embodiment. For example, a single boss and a single guide rail might be used. Similarly, several bosses and several guide rails might be used. A detailed description of the pair of guide rails 113 will be described below.

The cover 110 may include a pair of extensions 115 extending rearward from two ends of the cover part 111. The cover 110 may include a pair of rotation shafts 117 formed on the pair of extensions 115 and rotatably connected to the shelf 70. The shelf 70 may include a pair of rotation holes 72 to which the pair of rotation shafts 117 are rotatably connected.

The adjustment device 210 may vertically move the cover 110 so that the cover 110 adjusts the area which covers the front gap G1 formed between the drawer 80 and the front surface 70*a* of the shelf 70. The adjustment device 210 may be connected to the front surface of the cover 110.

The adjustment device 210 may include a moving bracket 211 connected to the front surface of the cover 110 to move in a left-right direction. The moving bracket 211 may be connected to the cover part 111 of the cover 110 to move in the left-right direction.

The adjustment device 210 may include a lever 213 formed to protrude forward from a front surface of the moving bracket 211. The lever 213 may be integrally formed with the moving bracket 211. The lever 213 may be exposed to the outside through an opening 71 of the shelf 70 which will be described below. Since the lever 213 is exposed to the outside, a user may adjust the lever 213 to adjust the area of the front gap G1. The opening 71 may be formed to be long in the left-right direction so that the lever 213 may move in the left-right direction. Accordingly, the lever 213 may move in the left-right direction along the opening 71. When the lever 213 moves in the left-right direction along the opening 71, the moving bracket 211 integrally formed with the lever 213 may move in the left-right direction with the lever 213.

The adjustment device 210 may include the pair of bosses 215 formed to protrude rearward from a rear surface of the moving bracket 211. The pair of bosses 215 may be formed on two ends of the moving bracket 211. The pair of bosses 215 may be inserted into the pair of guide rails 113 formed in the cover part 111 of the cover 110. The pair of bosses 215 may be guided by the pair of guide rails 113.

The guide rails 113 may be formed to extend in the left-right direction to guide the pair of bosses 215 moved in the left-right direction with the moving bracket 211. That is, when the moving bracket 211 moves in the left-right direction, the pair of bosses 215 may be guided by the pair of guide rails 113.

The pair of guide rails 113 may be obliquely formed. Since the pair of guide rails 113 are obliquely formed, when the moving bracket 211 is moved in the left-right direction by the lever 213, the pair of bosses 215 are guided along the pair of guide rails 113, and thus the cover 110 may be vertically rotated around the pair of rotation shafts 117. When the cover 110 is vertically rotated around the pair of rotation shafts 117, the cover part 111 may be vertically moved to adjust the area of the front gap G1.

The pair of guide rails 113 may each be obliquely formed such that a level of a right end is higher than that of a left end. Accordingly, when the lever 213 is moved leftward, the pair of bosses 215 may be positioned at the left ends of the pair of guide rails 113. In this case, the cover 110 is rotated upward, and the cover part 111 may open the entire front gap G1. When the lever 213 is moved from left to right, the pair of bosses 215 may be positioned at the right ends of the guide rails 113. In this case, the cover 110 may be rotated downward, and the cover part 111 may open only a part of the front gap G1. In the drawings, it is illustrated that the pair of guide rails 113 are obliquely formed so that the levels of the right ends are higher than those of the left ends, but present disclosure is not limited thereto. That is, it may also be illustrated that each of the pair of guide rails 113 is obliquely formed so that the level of the left end are higher than that of the right end. In this case, when the lever 213 is moved leftward, the pair of bosses 215 may be positioned at the left ends of the pair of guide rails 113. In this case, the cover 110 is rotated downward, and the cover part 111 may open only a part of the front gap G1. When the lever 213 is moved from left to right, the pair of bosses 215 may be positioned at the right ends of the guide rails 113. In this case, the cover 110 may be rotated upward, and the cover part 111 may open the entire front gap G1.

Then, an operation in which the cover adjusts the area of the front gap according to an operation of the layer will be described in detail with reference to FIGS. 6 to 9.

Figure 6:
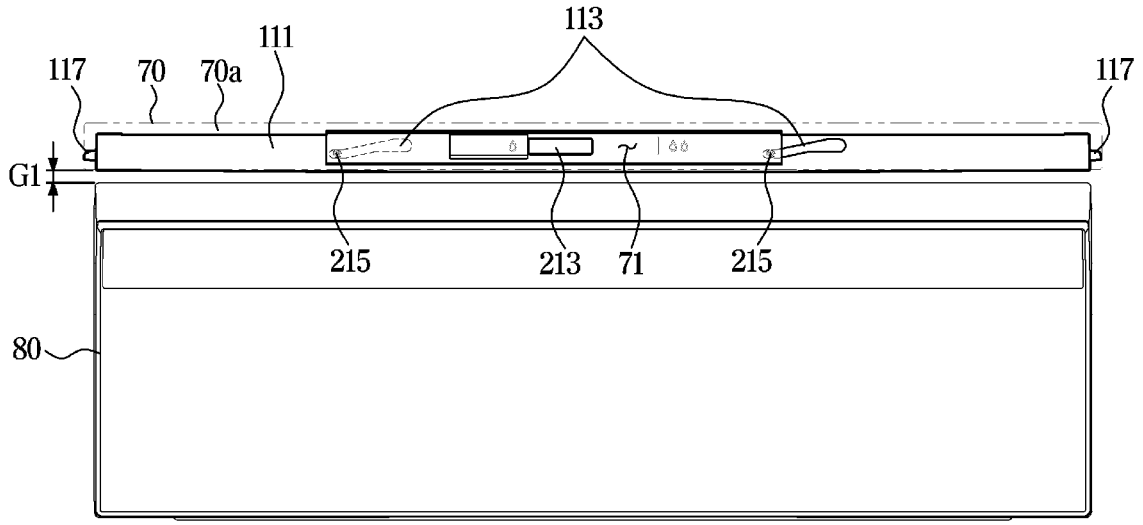
FIG. 6 is a view illustrating a lever moved to a left side of an opening formed in the shelf according to an embodiment.
Figure 7:
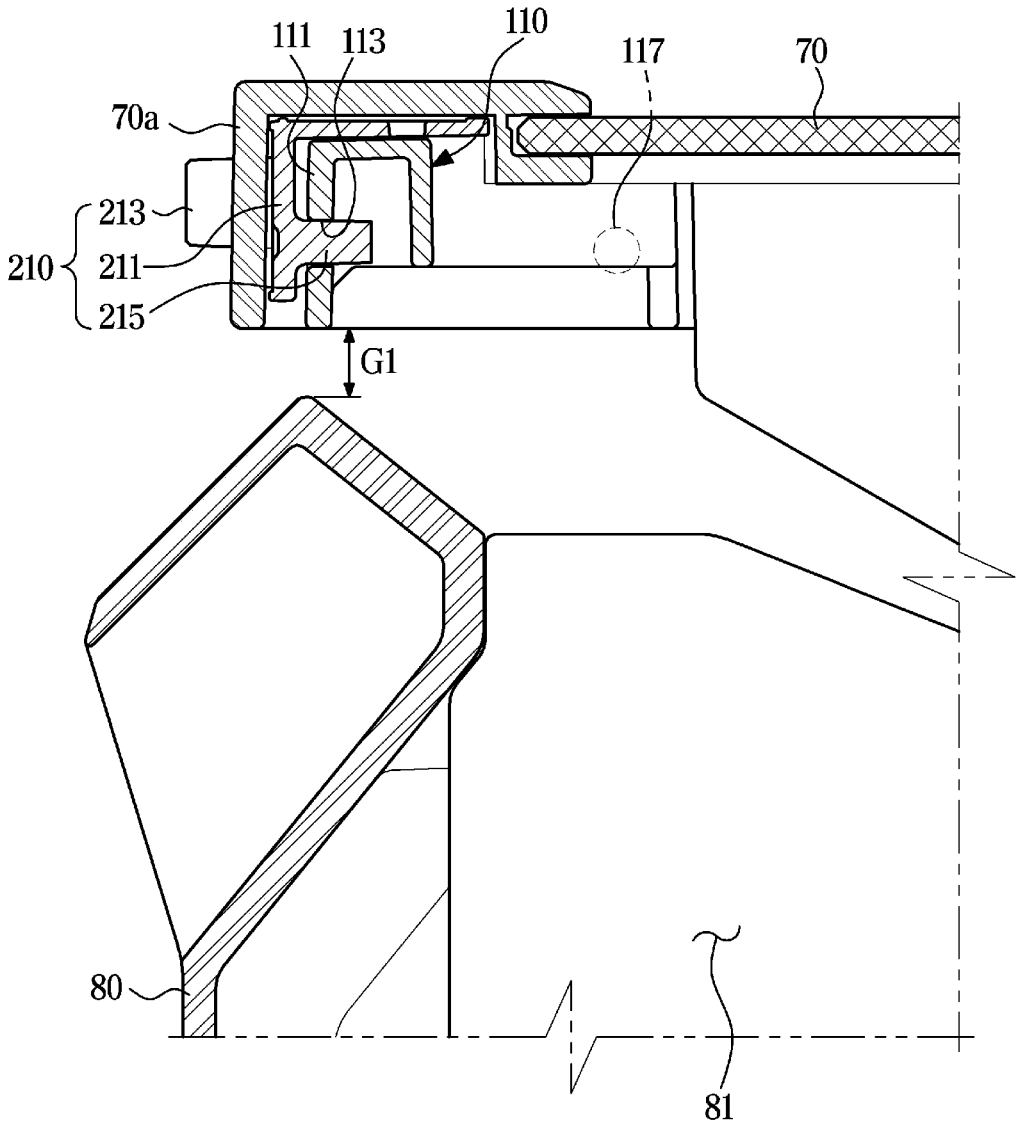
FIG. 7 is a view illustrating the cover which opens an entire front gap when the lever is moved to the left side of the opening formed in the shelf according to an embodiment.
Figure 8:
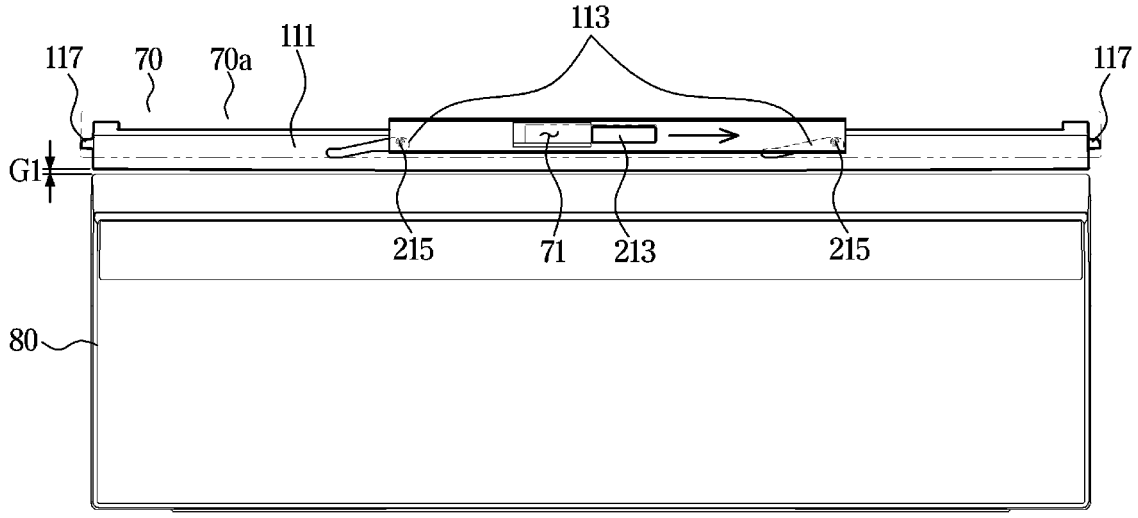
FIG. 8 is a view illustrating the lever moved to a right side of the opening formed in the shelf according to an embodiment.
Figure 9:
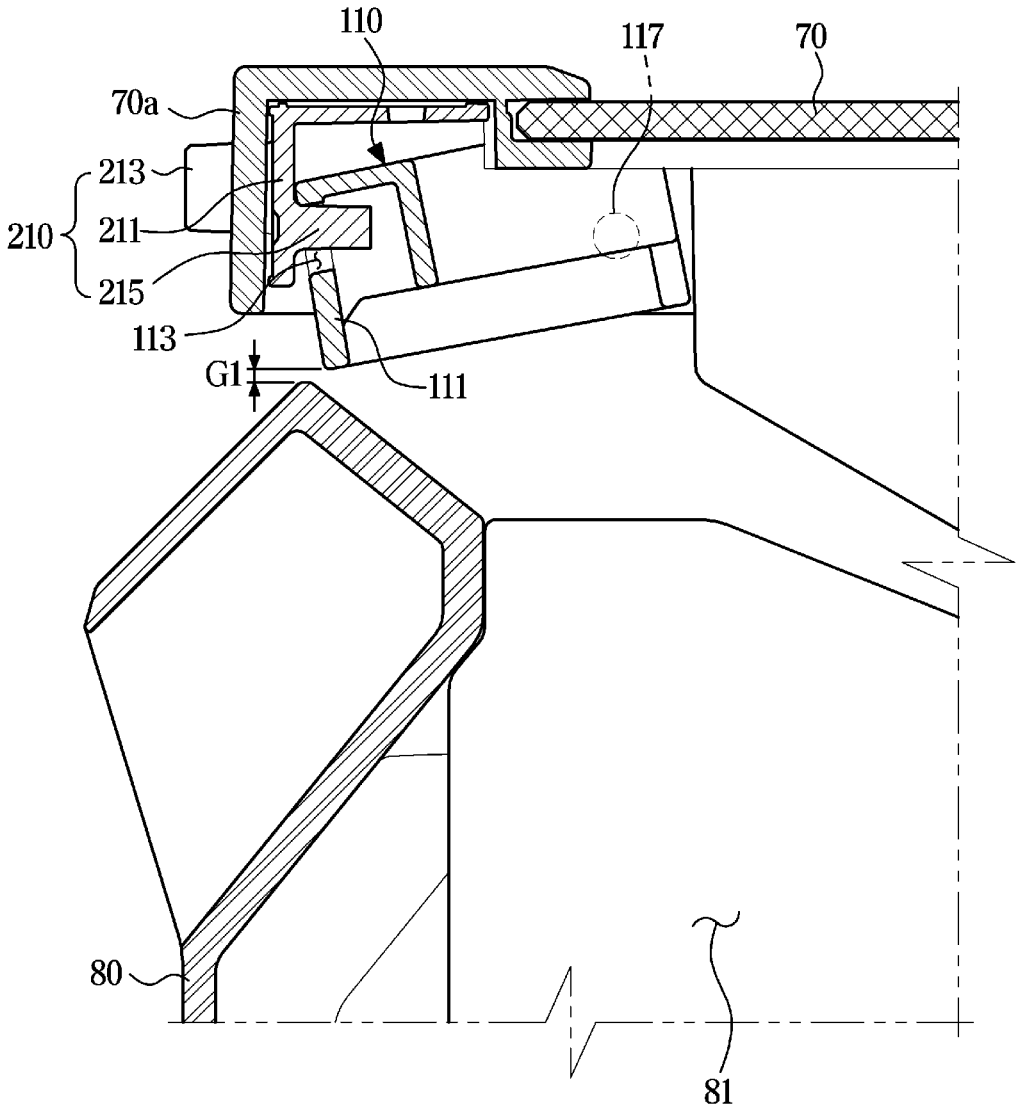
FIG. 9 is a view illustrating the cover which opens only a part of the front gap when the lever is moved to the right side of the opening formed in the shelf according to an embodiment.

FIG. 6 is a view illustrating the lever moved to a left side of the opening formed in the shelf according to an embodiment. FIG. 7 is a view illustrating the cover which opens the entire front gap when the lever is moved to the left side of the opening formed in the shelf according to an embodiment. FIG. 8 is a view illustrating the lever moved to a right side of the opening formed in the shelf according to an embodiment. FIG. 9 is a view illustrating the cover which opens only a part of the front gap when the lever is moved to the right side of the opening formed in the shelf according to an embodiment.

As illustrated in FIGS. 6 to 7, when the lever 213 is moved to a left side of the opening 71, the pair of bosses 215 may be positioned at the left ends of the pair of guide rails 113. In this case, since the cover 110 is rotated and moved upward, the entire front gap G1 may be opened.

As illustrated in FIGS. 8 to 9, when the lever 213 is moved from the left side to the right side of the opening 71, the pair of bosses 215 may be moved to the right ends of the pair of guide rails 113. That is, the pair of bosses 215 may be guided by the pair of guide rails 113 and moved to the right ends. When the pair of bosses 215 are moved from the left ends to the right ends along the pair of guide rails 113, the cover 110 may be rotated downward around the pair of rotation shafts 117. In this case, the cover part 111 may cover the front gap G1 so that only a part of the front gap G1 is opened.

As illustrated in FIGS. 6 to 7, when the lever 213 is moved from the right side to left side of the opening 71, the pair of bosses 215 may be moved from the right ends to the left ends of the pair of guide rails 113. That is, the pair of bosses 215 may be guided by the pair of guide rails 113 and moved to the left ends. When the pair of bosses 215 are moved from the right ends to the left ends along the pair of guide rails 113, the cover 110 may be rotated upward around the pair of rotation shafts 117. In this case, the cover part 111 may be rotated upward so that the entire front gap G1 is opened.

As described above, since a humidity in the storage space 81 in the drawer 80 is adjusted using only the cover 110 which covers the front gap G1 formed between the drawer 80 and the front surface 70*a* of the shelf 70 and the adjustment device 210 which vertically moves the cover 110, components for adjusting the humidity in the storage space 81 can be minimized.

Figure 10:
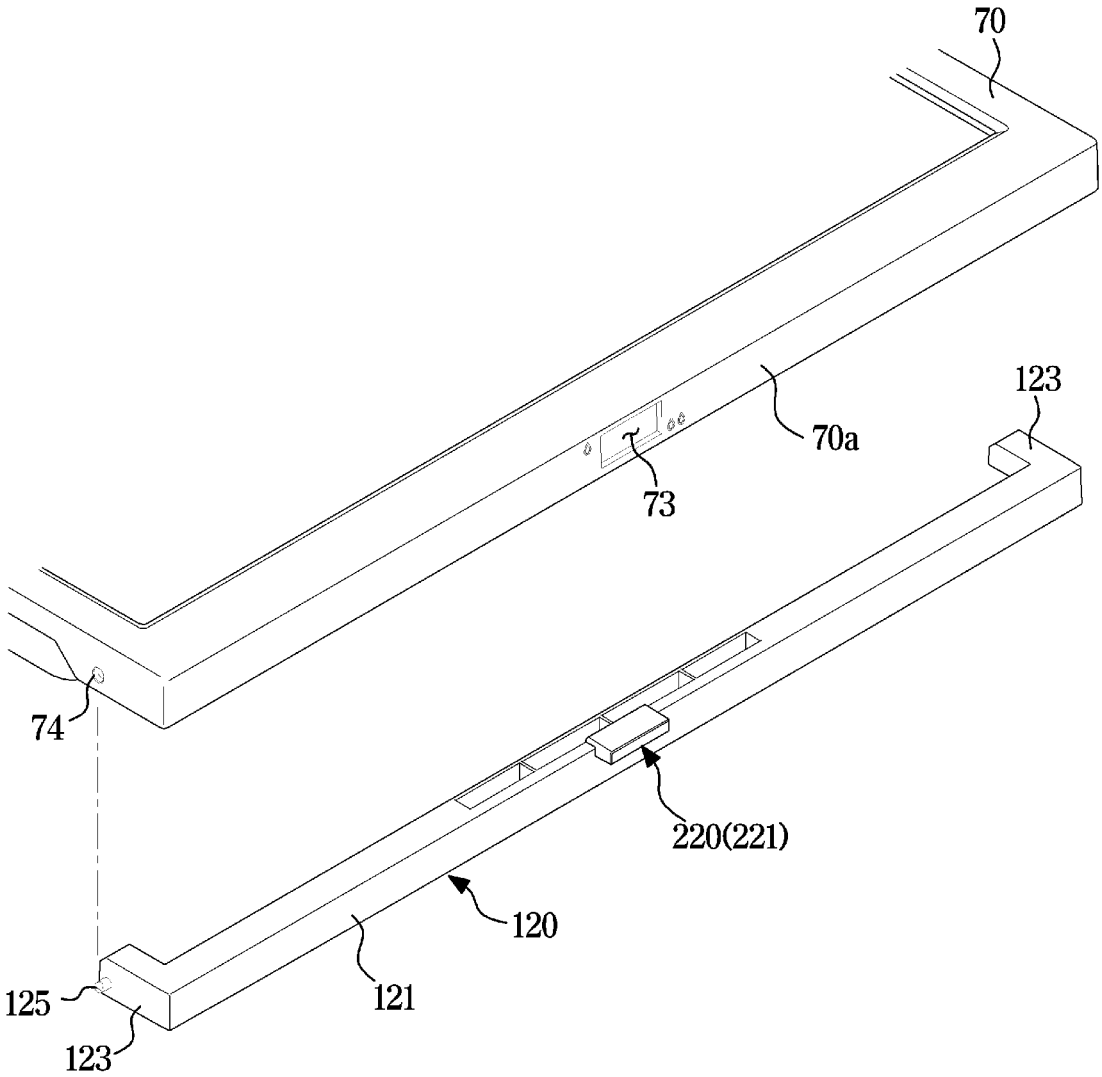
FIG. 10 is a view illustrating a cover and an adjustment device which are separated from a shelf according to an embodiment.

FIG. 10 is a view illustrating a cover and an adjustment device which are separated from a shelf according to an embodiment.

As illustrated in FIG. 10, a cover 120 may include a cover part 121 which covers a front gap G1 formed between a drawer 80 and a front surface 70*a* of a shelf 70. The cover part 121 may be formed on a front surface of the cover 120 to cover the front gap G1 and may adjust an area which covers the front gap G1 when the cover 120 is vertically moved. That is, when the cover part 121 is rotated upward, the front gap G1 may be fully opened. When the cover part 121 is rotated downward, only a part of the front gap G1 may be opened. Accordingly, the cover 120 may be vertically rotated so that the cover part 121 adjusts the area which covers the front gap G1, and thus the area of the front gap G1 can be adjusted (see FIG. 11).

The cover 120 may include a pair of extensions 123 extending rearward from two ends of the cover part 121. The cover 120 may include a pair of rotation shafts 125 formed on the pair of extensions 123 and rotatably connected to the shelf 70. The shelf 70 may include a pair of rotation holes 72 to which the pair of rotation shafts 125 are rotatably connected. The shelf 70 may include a pair of rotation holes 74 to which the pair of rotation shafts 125 are rotatably connected.

An adjustment device 220 (also referred to as a cover position adjuster) may vertically move the cover 120 so that the cover 120 adjusts the area which covers the front gap G1 (see FIG. 11) formed between the drawer 80 and the front surface 70*a* of the shelf 70. The adjustment device 220 may be integrally formed with the front surface of the cover 120. The adjustment device 220 may be integrally formed with a front surface of the cover part 121. The adjustment device 220 may be formed as a lever 221 integrally formed with the cover 120 to vertically move with the cover 120.

The lever 221 may be exposed to the outside through an opening 73 of the shelf 70. Since the lever 221 is exposed to the outside, a user may adjust an area of the front gap G1 (see FIG. 11) by adjusting the lever 221. The opening 73 may be formed to vertically extend so that the lever 221 may be vertically moved. Accordingly, the lever 221 may be vertically moved along the opening 73. That is, the lever 221 may be vertically rotated around the pair of rotation shafts 125 in the opening 73 of the shelf 70. When the lever 221 is vertically moved along the opening 73, the cover 120 integrally formed with the lever 221 may be vertically moved with the lever 221. That is, when the lever 221 is vertically rotated around the pair of rotation shafts 125 along the opening 73, the cover 120 integrally formed with the lever 221 may be vertically rotated around the pair of rotation shafts 125 with the lever 221.

Then, an operation in which the cover adjusts the area of the front gap according to an operation of the layer will be described in detail FIGS. 11 to 14.

Figure 11:
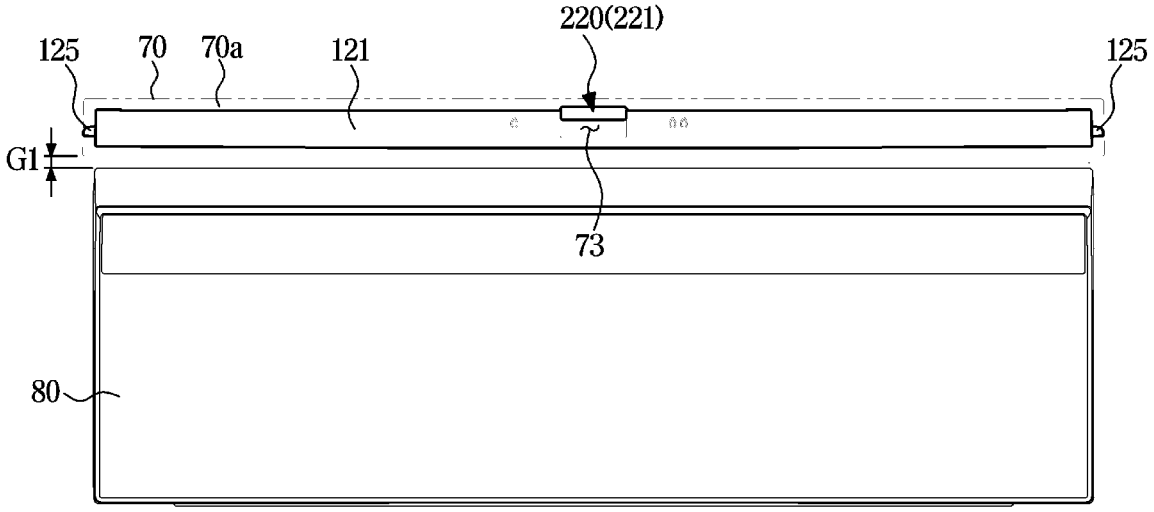
FIG. 11 is a view illustrating a lever moved on an opening formed in the shelf according to an embodiment.
Figure 12:
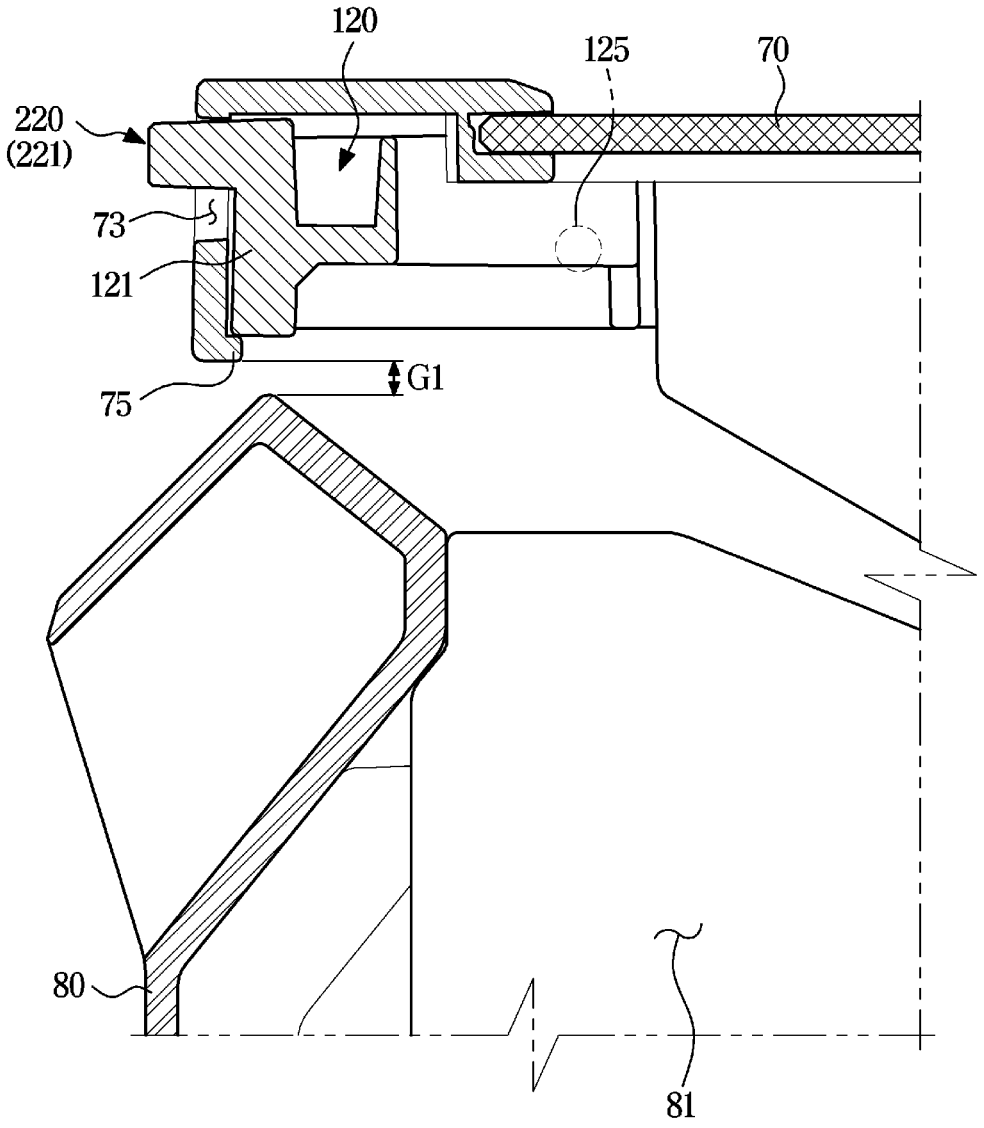
FIG. 12 is a view illustrating the cover which opens an entire front gap when the lever is moved on the opening formed in the shelf according to an embodiment.
Figure 13:
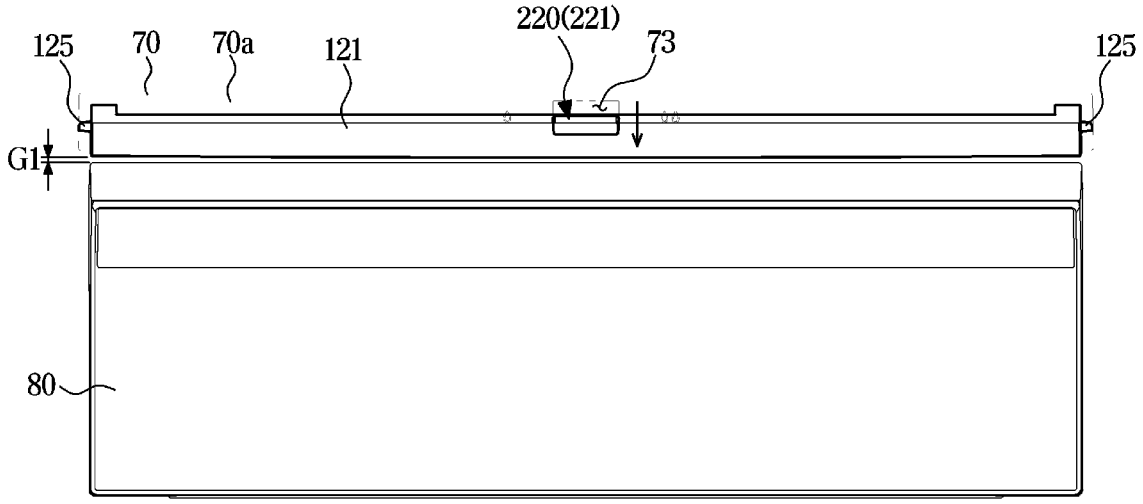
FIG. 13 is a view illustrating the lever moved under the opening formed in the shelf according to an embodiment.
Figure 14:
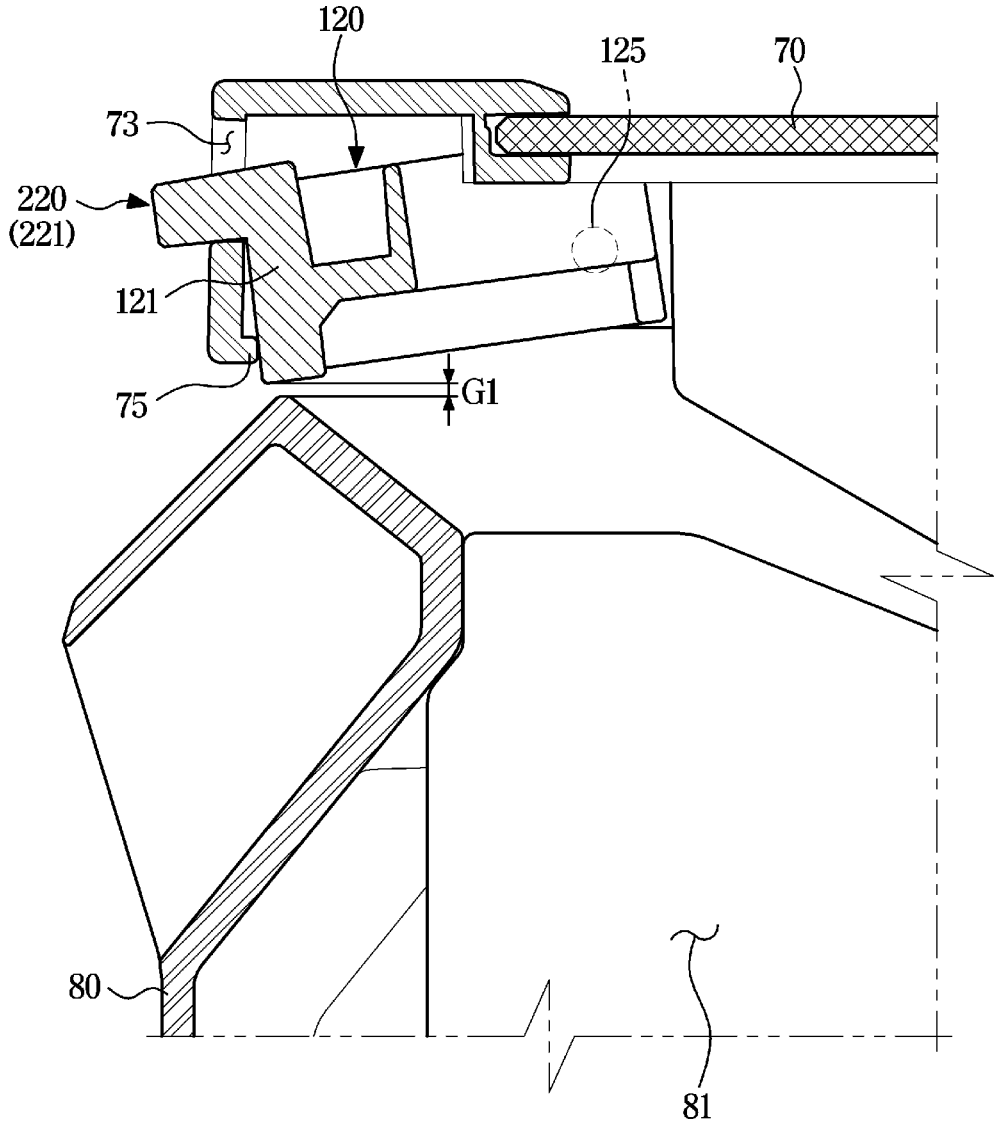
FIG. 14 is a view illustrating the covers which opens only a part of the front gap when the lever is moved under the opening formed in the shelf according to an embodiment.

FIG. 11 is a view illustrating the lever moved on an opening formed in the shelf according to an embodiment FIG. 12 is a view illustrating the cover which opens the entire front gap when the lever is moved on the opening formed in the shelf according to an embodiment. FIG. 13 is a view illustrating the lever moved under the opening formed in the shelf according to an embodiment. FIG. 14 is a view illustrating the covers which opens only a part of the front gap when the lever is moved under the opening formed in the shelf according to an embodiment.

As illustrated in FIGS. 11 to 12, when the lever 221 is moved in the opening 73, since the cover 120 is moved upward with the lever 221, the entire front gap may be opened. That is, since both the lever 221 and the cover 120 are rotated upward around the pair of rotation shafts 125, the entire front gap G1 may be opened. In this case, the cover 120 may be supported by a support rib 75 formed on the shelf 70. The support rib 75 may be formed under the opening 73 to protrude rearward.

As illustrated in FIGS. 13 to 14, when the lever 221 is moved downward from an upper portion of the opening 73, the cover 120 may be moved downward with the lever 221. That is, when the lever 221 is rotated downward around the pair of rotation shafts 125 and moved downward from the upper portion of the opening 73, the cover 120 may be rotated downward around the pair of rotation shafts 125 with the lever 221. When the lever 221 is rotated downward around the pair of rotation shafts 125 in the opening 73, the cover 120 may be rotated downward around the pair of rotation shafts 125 while escaping from the support rib 75. When the lever 221 is rotated downward around the pair of rotation shafts 125 in the opening 73, the lever 221 may be supported by a lower end of the opening 73. In this case, the cover part 121 may cover the front gap G1 so that only a part of the front gap G1 is opened.

As illustrated in FIGS. 11 to 12, when the lever 221 is moved upward from a lower portion of the opening 73, the cover 120 may be rotated upward around the pair of rotation shafts 125 with the lever 221. When the lever 221 is rotated upward around the pair of rotation shafts 125 in the opening 73, the cover 120 may be rotated upward around the pair of rotation shafts 125 and supported by the support rib 75. In this case, the cover part 121 may be rotated upward so that the entire front gap G1 is opened.

Figure 15:
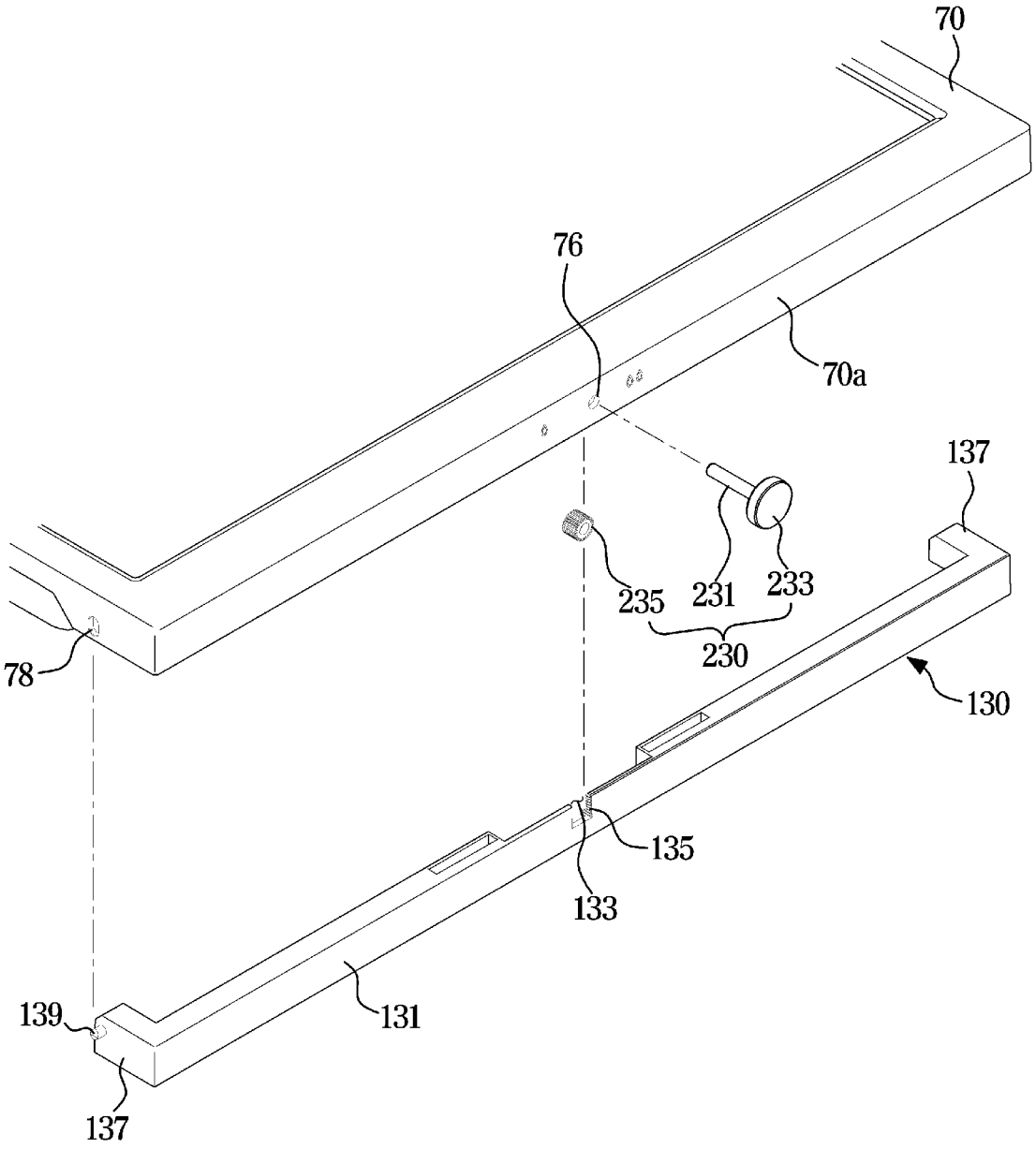
FIG. 15 is a view illustrating a cover and an adjustment device separated from a shelf according to an embodiment.

FIG. 15 is a view illustrating a cover and an adjustment device separated from a shelf according to an embodiment.

As illustrated in FIG. 15, a cover 130 may include a cover part 131 which covers a front gap G1 formed between a drawer 80 and a front surface 70*a* of a shelf 70. The cover part 131 may be formed on a front surface of the cover 130 to cover the front gap G1 and may adjust an area which covers the front gap G1 when the cover 130 is vertically moved. That is, when the cover part 131 is moved upward, the entire front gap G1 may be opened. When the cover part 131 is moved downward, only a part of the front gap G1 may be opened. Accordingly, the cover 130 may be vertically moved so that the cover part 131 adjusts the area which covers the front gap G1, and thus the area of the front gap G1 can be adjusted (See FIG. 16).

The cover 130 may include an accommodation part 133 formed in a central portion of the cover part 131 to form a space in which a rotation gear 235 of an adjustment device 230 (also referred to as a cover position adjuster), which will be described below, is accommodated. A connecting shaft 231 of the adjustment device 230 may pass through the cover 130 through the accommodation part 133 and may be connected to the shelf 70.

The cover 130 may include a rack gear 135 engaged with the rotation gear 235 at one side of the accommodation part 133. The rack gear 135 may be formed on one sidewall of the accommodation part 133 to vertically move when the rotation gear 235 is rotated. Accordingly, when the rotation gear 235 is rotated, the cover 130 may be vertically moved by the rack gear 135.

The cover 130 may include a pair of extensions 137 extending rearward from two ends of the cover part 131. The cover 130 may include a pair of moving shafts 139 formed on the pair of extensions 137 and be vertically movably connected to the shelf 70. The shelf 70 may include a pair of guide holes 78 which guide the pair of moving shafts 139 to vertically move. That is, the pair of moving shafts 139 may be vertically moved along the pair of guide holes 78. The guide holes 78 may be formed to vertically extend to guide the vertical movement of the moving shafts 139.

The adjustment device 230 may include the connecting shaft 231 rotatably coupled to the front surface 70*a* of the shelf 70. The shelf 70 may include a through hole 76 which is formed in the front surface 70*a* of the shelf 70 so that the connecting shaft 231 passes through the through hole 76. The shelf 70 may include a fixing groove 77 in which a rear end of the connecting shaft 231 passing through the hole 76 is rotatably fixed. The fixing groove 77 may be formed behind the through hole 76. Accordingly, the connecting shaft 231 may pass through the through hole 76 from the front of the shelf 70 and may be rotatably fixed to the fixing groove 77 (See FIG. 17).

The adjustment device 230 may include a dial lever 233 provided on a front end of the connecting shaft 231. The dial lever 233 may be provided to rotate with the connecting shaft 231. That is, the dial lever 233 may be rotated around the connecting shaft 231 in a left-right direction with the connecting shaft 231. The dial lever 233 may be exposed from the front surface 70*a* of the shelf 70. Accordingly, a user may adjust an area of the front gap G1 (see FIG. 16) by adjusting the dial lever 233.

The adjustment device 230 may include the rotation gear 235 fixed to the connecting shaft 231 to rotate with the connecting shaft 231 when the dial lever 233 is rotated. The rotation gear 235 may be disposed behind the dial lever 233. When the dial lever 233 is rotated around the connecting shaft 231 in the left-right direction, the rotation gear 235 may be rotated around the connecting shaft 231 in the left-right direction together. When the rotation gear 235 is rotated around the connecting shaft 231 in the left-right direction, the rack gear 135 engaged with the rotation gear 235 may be vertically moved. Accordingly, the cover 130 may be vertically moved by the rack gear 135 when the rotation gear 235 is rotated around the connecting shaft 231 in the left-right direction.

Then, an operation in which the cover adjusts the area of the front gap according to an operation of the dial layer will be described in detail FIGS. 16 to 19.

Figure 16:
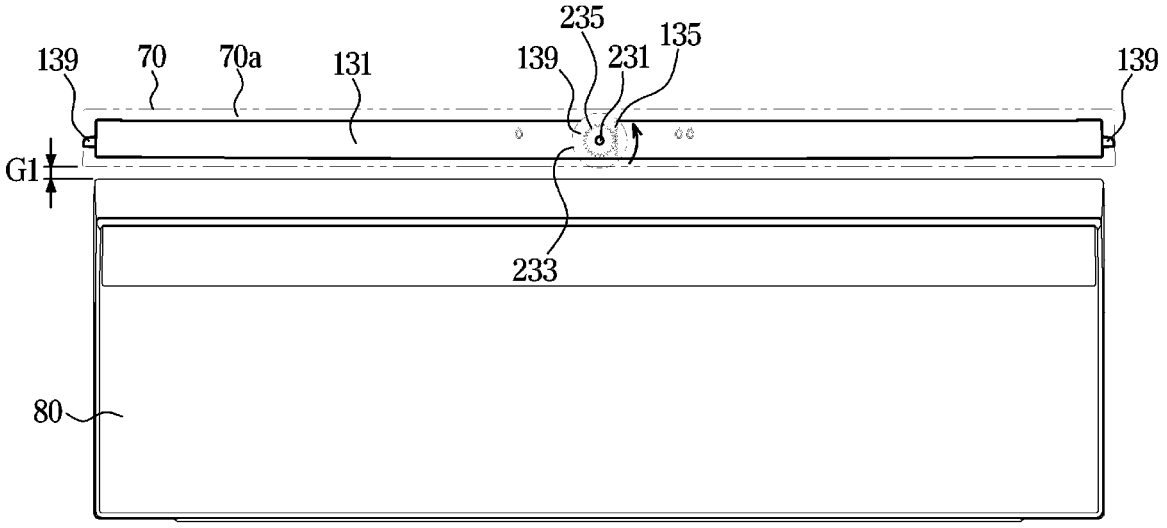
FIG. 16 is a view illustrating a dial lever rotated leftward around a connecting shaft according to an embodiment.
Figure 17:
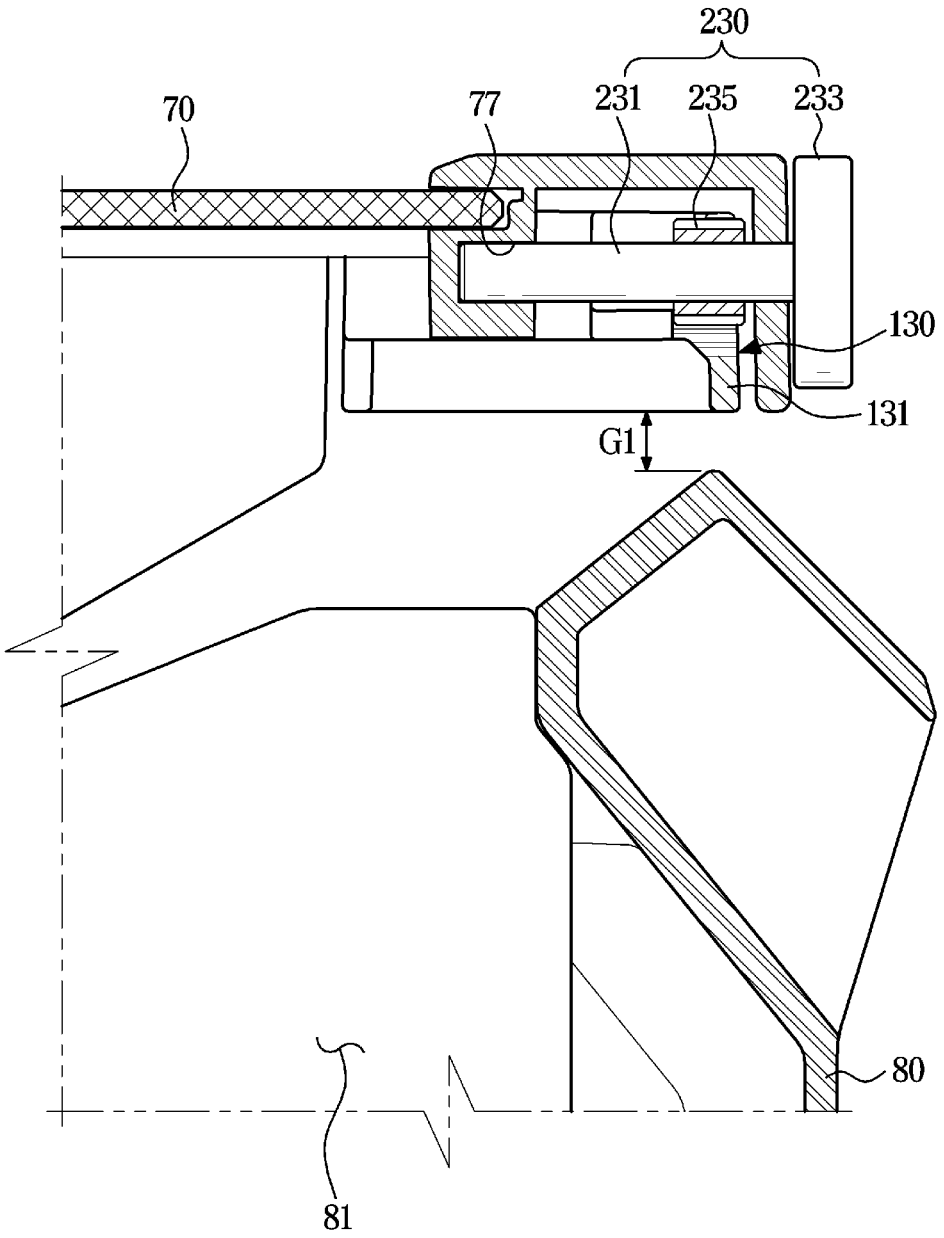
FIG. 17 is a view illustrating the cover which opens an entire front gap when the dial lever is rotated leftward around the connecting shaft according to an embodiment.
Figure 18:
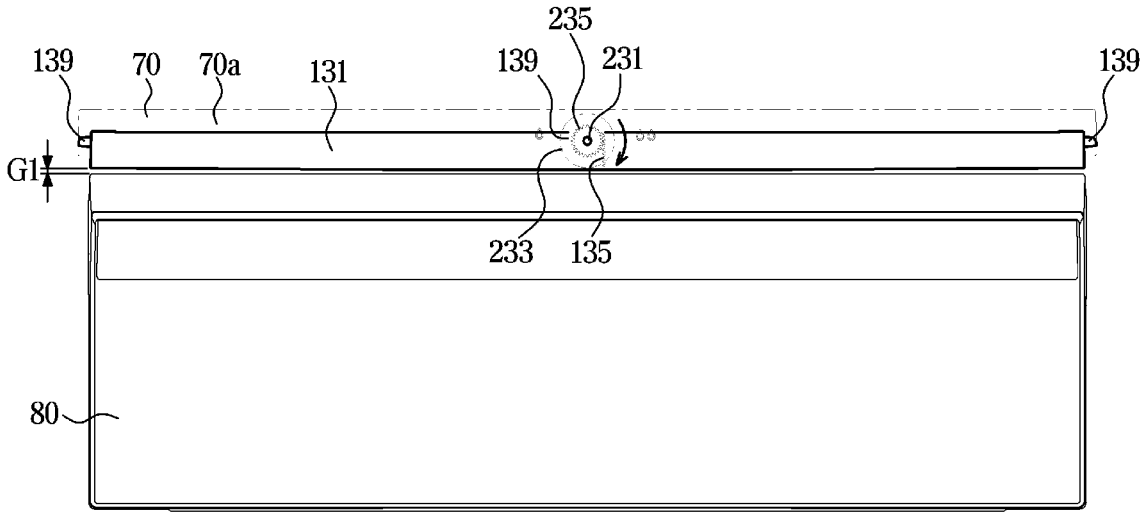
FIG. 18 is a view illustrating the dial lever rotated rightward around the connecting shaft according to an embodiment.
Figure 19:
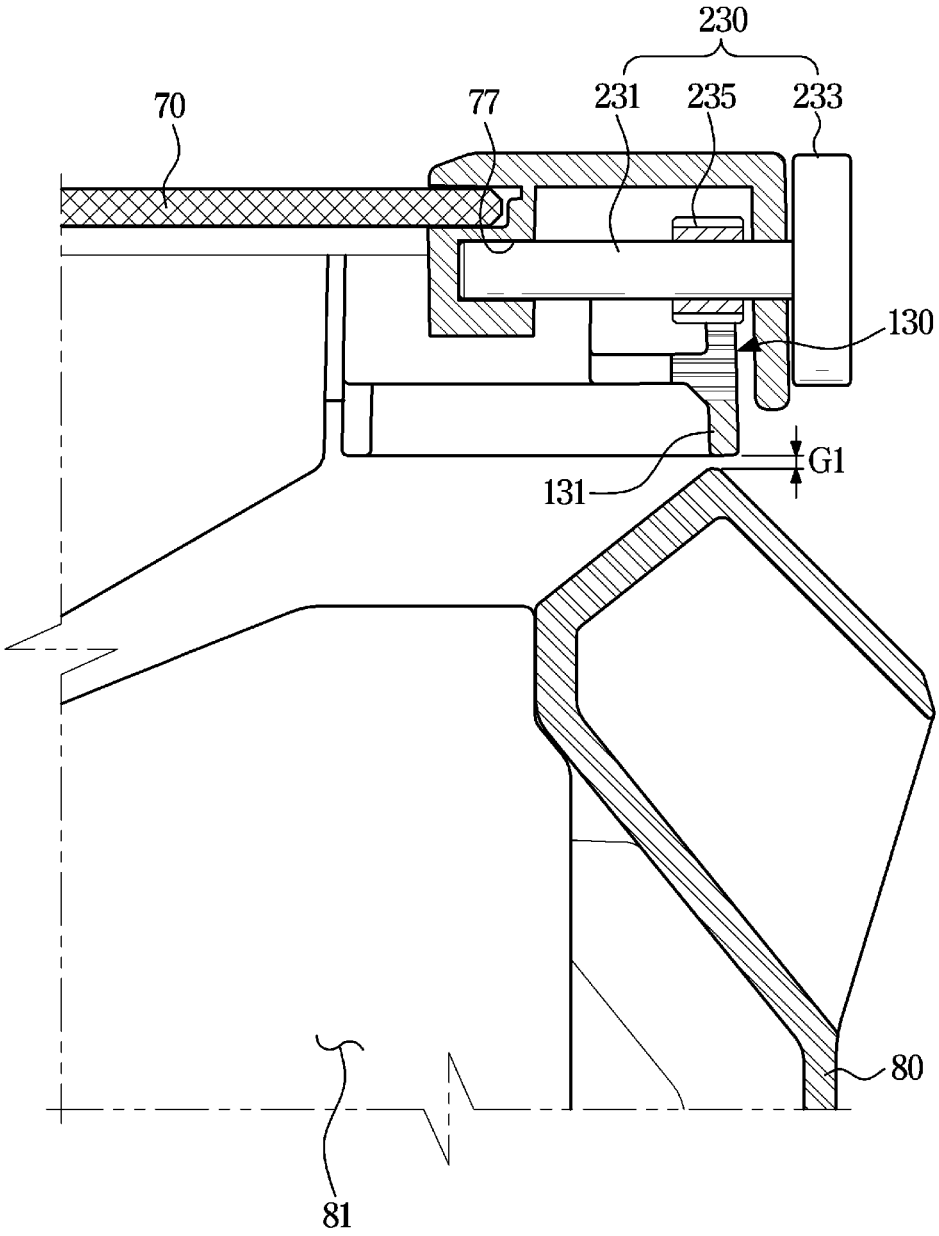
FIG. 19 is a view illustrating the cover which opens only a part of the front gap when the dial lever is rotated rightward around the connecting shaft according to an embodiment.

FIG. 16 is a view illustrating the dial lever rotated leftward (counterclockwise) around the connecting shaft according to an embodiment. FIG. 17 is a view illustrating the cover which opens the entire front gap when the dial lever is rotated leftward (counterclockwise) around the connecting shaft according to an embodiment. FIG. 18 is a view illustrating the dial lever rotated rightward (clockwise) around the connecting shaft according to an embodiment. FIG. 19 is a view illustrating the cover which opens only a part of the front gap when the dial lever is rotated rightward (clockwise) around the connecting shaft according to an embodiment.

As illustrated in FIGS. 16 to 17, when the dial lever 233 is rotated leftward around the connecting shaft 231, since the cover 130 is moved upward, the entire front gap G1 may be opened. That is, since the cover 130 is moved upward by the dial lever 233 rotated leftward around the connecting shaft 231, the entire front gap G1 can be opened.

As illustrated in FIGS. 18 to 19, when the dial lever 233 is rotated rightward around the connecting shaft 231, the rotation gear 235 may also be rotated rightward around the connecting shaft 231. When the rotation gear 235 is rotated rightward around the connecting shaft 231, the rack gear 135 engaged with the rotation gear 235 may be moved downward. When the rack gear 135 is moved downward, the cover 130 may be moved downward by the rack gear 135. In this case, the cover part 131 may cover the front gap G1 so that only a part of the front gap G1 is opened.

When the dial lever 233 is rotated leftward around the connecting shaft 231, the rotation gear 235 may be rotated leftward around the connecting shaft 231. When the rotation gear 235 is rotated leftward around the connecting shaft 231, the rack gear 135 engaged with the rotation gear 235 may be moved upward. When the rack gear 135 is moved upward, the cover 130 may be moved upward by the rack gear 135. In this case, the cover part 131 opens the entire front gap G1.

According to embodiments of the disclosure, an area of a front gap formed between a drawer and a front surface of a shelf can be adjusted to adjust a humidity in the drawer.

In addition, a total area of a front gap formed between a drawer and a front surface of a shelf can be adjusted to improve humidity control performance.

In addition, a humidity in a drawer can be adjusted only using a cover which covers a front gap formed between the drawer and a front surface of a shelf and an adjustment device which vertically moves the cover, and thus components can be minimized.

The effects that can be obtained from the present disclosure are not limited to the effects mentioned above, and other effects not mentioned will be clearly understood by those skilled in the art from the above detailed description.

Specific shapes and specific directions of a refrigerator have been described above with reference to the accompanying drawings, but the present disclosure may be variously modified and changed by those skilled in the art, and the modifications and changes should be interpreted as being included in the scope of the present disclosure.

What is claimed is:

1. A refrigerator comprising:

a main body;

a storage chamber provided in the main body so that a front side of the storage chamber is open;

a drawer provided in the storage chamber and configured to be inserted into and withdrawn from the storage chamber, wherein an interior of the drawer forms a storage space;

a shelf provided on the drawer, wherein a front surface of the shelf and the drawer are spaced apart by a gap;

a cover vertically movably connected to the shelf and configured to cover the gap; and a cover position adjuster contacting the shelf and the cover and configured to adjust an area of the gap by vertically moving the cover, wherein the cover position adjuster is on a frontmost surface of the cover nearest the front side of the storage chamber;

wherein the cover comprises:

a pair of extensions extending rearward from an end of the cover; and a pair of rotation shafts provided on the pair of extensions and rotatably connected to the shelf, and wherein the pair of rotation shafts are closer to the front surface of the shelf than to a rear surface of the shelf, the rear surface of the shelf being opposite the front surface of the shelf.

2. The refrigerator of claim 1, wherein the cover position adjuster comprises:

a moving bracket connected to a front surface of the cover and configured to move in a left-right direction;

a lever protruding forward from a front surface of the moving bracket; and at least one boss protruding rearward from a rear surface of the moving bracket and configured to vertically move the cover as the moving bracket moves in the left-right direction.

3. The refrigerator of claim 2, wherein the cover comprises at least one guide rail configured to receive the at least one boss and to guide the at least one boss as the moving bracket moves in the left-right direction.

4. The refrigerator of claim 3, wherein the at least one guide rail is obliquely formed so that the cover is vertically rotated around the pair of rotation shafts as the moving bracket moves in the left-right direction.

5. The refrigerator of claim 2, wherein the front surface of the shelf comprises an opening in which the lever is received and exposed to an outside; and wherein the lever is configured to move along the opening in the left-right direction.

6. The refrigerator of claim 1, wherein the shelf comprises a pair of rotation holes to which the pair of rotation shafts are rotatably coupled.

7. The refrigerator of claim 1, wherein the cover position adjuster comprises a lever integrally formed with the cover and configured to vertically move with the cover; and wherein the lever protrudes forward from a front surface of the cover.

8. The refrigerator of claim 7, wherein the front surface of the shelf comprises:

an opening in which the lever is received and exposed to an outside, and wherein the shelf comprises:

a support rib protruding rearward from a lower portion of the front surface of the shelf under the opening and configured to support the cover; and a pair of rotation holes to which the pair of rotation shafts are rotatably connected.

9. The refrigerator of claim 8, wherein the support rib is configured to support the cover when the lever is positioned at an upper portion of the opening, wherein rotating the lever downward around the pair of rotation shafts in the opening causes the cover to escape from the support rib and to rotate downward around the pair of rotation shafts, and wherein the lever is supported by a lower end of the opening when the lever is positioned at a lower portion of the opening.

10. The refrigerator of claim 1, wherein the cover position adjuster comprises:

a connecting shaft rotatably connected to the front surface of the shelf;

a dial lever provided on a front end of the connecting shaft and configured to rotate with the connecting shaft; and a rotation gear fixed to the connecting shaft and configured to rotate with the connecting shaft according to rotation of the dial lever.

11. A refrigerator comprising:

a main body;

a storage chamber provided in the main body so that a front side of the storage chamber is open;

a drawer provided in the storage chamber and configured to be inserted into and withdrawn from the storage chamber, wherein an interior of the drawer forms a storage space;

a shelf provided on the drawer, wherein a front surface of the shelf and the drawer are spaced apart by a gap;

a cover vertically movably connected to the shelf and configured to cover the gap; and a cover position adjuster contacting the shelf and the cover and configured to adjust an area of the gap by vertically moving the cover, wherein the cover position adjuster comprises:

a connecting shaft rotatably connected to the front surface of the shelf;

a dial lever provided on a front end of the connecting shaft and configured to rotate with the connecting shaft; and a rotation gear fixed to the connecting shaft and configured to rotate with the connecting shaft according to rotation of the dial lever, and wherein the cover comprises:

a cover part configured to cover the gap;

an accommodation part provided in a central portion of the cover part to form a space in which the rotation gear is accommodated;

a rack gear engaged with the rotation gear to vertically move according to rotation of the rotation gear;

a pair of extensions extending rearward from two ends of the cover part; and a pair of moving shafts provided on the pair of extensions and vertically movably connected to the shelf.

12. The refrigerator of claim 11, wherein the shelf comprises:

a through hole through which the connecting shaft passes;

a fixing groove in which a rear end of the connecting shaft is rotatably fixed; and a pair of guide holes configured to receive the pair of moving shafts and to guide the pair of moving shafts to move vertically.

13. The refrigerator of claim 12, wherein rotation of the dial lever in a left-right direction causes the cover to vertically move through engagement of the rotation gear with the rack gear, and causes the pair of moving shafts to vertically move along the pair of guide holes.

14. A refrigerator comprising:

a main body;

a storage chamber provided in the main body so that a front side of the storage chamber is open;

a drawer provided in the storage chamber and configured to be inserted into and withdrawn from the storage chamber, wherein an interior of the drawer forms a storage space;

a shelf provided on the drawer, wherein a front surface of the shelf and the drawer are spaced apart by a gap;

a cover configured to cover the gap and to vertically move to adjust an area of the gap;

a cover position adjuster provided on a frontmost surface of the cover nearest the front side of the storage chamber, and configured to vertically move the cover to adjust a humidity in the storage space;

wherein the cover comprises a pair of rotation shafts vertically rotatably connected to the shelf, wherein the cover is configured to vertically rotate around the pair of rotation shafts when the cover moves to adjust the area of the gap, and wherein the pair of rotation shafts are closer to the front surface of the shelf than to a rear surface of the shelf, the rear surface of the shelf being opposite the front surface of the shelf.

15. The refrigerator of claim 14, wherein the cover position adjuster comprises a lever exposed to an outside through an opening formed in the front surface of the shelf, and wherein the cover is connected to the lever and configured to be vertically moved by the lever.

16. The refrigerator of claim 14, wherein the cover position adjuster comprises:

a connecting shaft rotatably connected to the front surface of the shelf;

a dial lever provided on a front end of the connecting shaft and configured to rotate with the connecting shaft; and a rotation gear fixed to the connecting shaft and configured to rotate with the connecting shaft according to rotation of the dial lever.

17. The refrigerator of claim 16, wherein the cover comprises a rack gear engaged with the rotation gear to vertically move according to rotation of the rotation gear, and wherein rotation of the dial lever in a left-right direction causes the cover to vertically move.

* * * * *